US005945246A

United States Patent [19]

Kawaji et al.

[11] Patent Number: 5,945,246

[45] **Date of Patent: *Aug. 31, 1999**

[54] PROCESS FOR PRODUCING A TONER FOR ELECTROPHOTOGRAPHY

[75] Inventors: Hiroyuki Kawaji, Wakayama; Eizi Morimoto, Wakayama-ken; Ken-ichi Suenaga, Wakayama; Tetsuhiro Semura, Wakayama; Katsutoshi Aoki, Wakayama; Kuniyasu Kawabe, Wakayama, all of Japan

[73] Assignee: KAO Corporation, Tokyo, Japan

[ * ] Notice: This patent is subject to a terminal disclaimer.

[21] Appl. No.: 09/094,589

[22] Filed: Jun. 15, 1998

Related U.S. Application Data

[62] Division of application No. 08/650,034, May 17, 1996, which is a continuation of application No. 08/233,406, Apr. 26, 1994, abandoned.

[30] Foreign Application Priority Data

Apr. 27, 1993 [JP] Japan ..... 5-101113

[51] Int. Cl.[6] ..... G03G 9/087

[52] U.S. Cl. ..... 430/137; 430/109; 430/111; 430/904

[58] Field of Search ..... 430/137, 110, 430/111, 109, 904; 525/132, 170, 172, 174

[56] References Cited

U.S. PATENT DOCUMENTS

| | | | |
|---|---|---|---|
| 4,027,048 | 5/1977 | Crystal | 427/14 |
| 4,415,645 | 11/1983 | Kouchi et al. | 430/107 |
| 4,713,310 | 12/1987 | Horie | 430/109 |
| 5,250,382 | 10/1993 | Shimojo et al. | 430/109 |
| 5,252,421 | 10/1993 | Ichimura et al. | 430/110 |
| 5,318,871 | 6/1994 | Inagaki et al. | 430/106 |
| 5,342,122 | 8/1994 | Ito et al. | 430/109 |
| 5,391,695 | 2/1995 | Kawabe et al. | 430/109 |
| 5,483,016 | 1/1996 | Aoki et al. | 430/109 |
| 5,514,511 | 5/1996 | Iwamoto et al. | 430/110 |

FOREIGN PATENT DOCUMENTS

| | | |
|---|---|---|
| 0479275 | 4/1992 | European Pat. Off. . |
| 0493097 | 7/1992 | European Pat. Off. . |
| 0509464 | 10/1992 | European Pat. Off. . |
| 63-68854 | 3/1988 | Japan . |
| 2280039 | 1/1995 | United Kingdom . |

OTHER PUBLICATIONS

*Chemical Dictionary Iwanami Rikagaku Jiten,* Published by Iwanami Shoten (1987) p. 818, With Attached English–Language Translation of p. 818, Left Column, Lines 9–2 From Bottom of Page.

Patent & Trademark Office English Translation of Japanese Patent No. 63–68854 (Pub Mar. 1988).

English abstract of JP–A–49–65232 (Pub Jun. 1974).

English abstract of JP–A–50–28840 (Pub Mar. 1975).

English abstract of JP–A–50–81342 (Pub Jul. 1975).

English abstract of JP–A–49–6931 (Pub Jan. 1974).

English abstract of JP–A–54–114245 (Pub Sep. 1979).

English abstract of JP–A–2–161464 (Pub Jun. 1990).

English abstract of JP–A–56–116043 (Pub Sep. 1981).

English abstract of JP–A–57–60339 (Pub Apr. 1982).

English abstract of JP–A–63–279265 (Pub Nov. 1988).

English abstract of JP–A–1–156759 (Pub Jun. 1989).

English abstract of JP–A–2–5073 (Pub Oct. 1990).

English abstract of JP–A–59–45453 (Pub Mar. 1984).

English abstract of JP–A–2–29664 (Pub Jan. 1990).

English abstract of JP–A–2–881 (Pub Oct. 1990).

English abstract of JP–A–4–366176 (Pub Dec. 1992).

English abstract of JP–A–4–366854 (Pub Dec. 1992).

English abstract of JP–A–4–142301 (Pub May 1992).

*Primary Examiner*—Janis L. Dote

*Attorney, Agent, or Firm*—Birch, Stewart, Kolasch & Birch, LLP

[57] ABSTRACT

The toner for electrophotography contains a binder resin, wherein the binder resin has a condensation polymerization-type resin for forming a matrix and an addition polymerization-type resin for forming a dispersed domain. The dispersed domain with a cross-sectional diameter of not more than 2 $\mu$m has an areal proportion of not less than 90%, based on the total cross-sectional area of the dispersed domain. This toner is stable, which is capable of maintaining a suitable tribo electric charge, thereby providing a high image quality in which the formed images do not undergo deterioration even under severe environmental conditions. Moreover, in a fixing method using a heat roller; fixing at a low temperature can be performed without using an offset inhibiting liquid.

4 Claims, No Drawings

PROCESS FOR PRODUCING A TONER FOR ELECTROPHOTOGRAPHY

This application is a divisional of application Ser. No. 08/650,034, filed on May 17, 1996 , which is a continuation application of Ser. No. 08/233,406 filed Apr. 26. 1994, now abandoned the entire contents of which are hereby incorporated by reference.

BACKGROUND OF THE INVENTION

1. Field of the Invention

The present invention relates to a toner for electrophotography which is a stable toner capable of maintaining a suitable tribo electric charge, thereby providing a high image quality so that the formed images do not undergo deterioration even under severe environmental conditions.

2. Discussion of the Related Art

As described in U.S. Pat. Nos. 2,297,691 and 2,357,809 and other publications, the conventional electrophotography comprises the steps of forming an electrostatic latent image by evenly charging a photoconductive insulating layer and subsequently exposing the layer to eliminate the charge on the exposed portion and visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process).

As stated above, a toner must meet the requirements not only in the development process but also in the transfer process and fixing process.

In the above processes, contact heat-fixing methods such as a heat roller fixing and non-contact heat-fixing methods such as an oven fixing can be used for the fixing process. Since the contact method is characterized by having a good thermal efficiency, the temperature of the fixing device can be lowered when compared with that of the non-contact method, thereby making it effective for energy conservation and miniaturization of the overall copying machine. However, in this contact heat-fixing method, the toner is likely to cause a so-called "offset phenomenon," wherein the toner is adhered to the surface of the heat roller, and thus transferred to a subsequent transfer paper. In order to prevent this phenomenon, the surface of a heat roller may be coated with a material excellent in release properties, such as a fluororesin, or a releasing agent such as a silicone oil may be applied on the surface of a heat roller. However, the method of applying a silicone oil necessitates a larger-scale fixing device, which is not only expensive but also complicated, which in turn may undesirably bring about various problems.

Conventionally, vinyl resins typically represented by styrene-acrylic copolymer are used for toners for these systems. When the vinyl resins are used, it is necessary to increase the softening point and the crosslinking density of the resins in order to increase the offset resistance of the toner, which in turn undesirably makes the low-temperature fixing ability of the resulting toner poor. On the contrary, when too much emphasis is placed on the improvement of the low-temperature fixing ability, the resulting toner may suffer from poor offset resistance and blocking resistance. Also, methods in which paraffin waxes, low-molecular weight polyolefins and the like are added as offset inhibitors have been known (see Japanese Patent Laid-Open No. 49-65232, 50-28840 and 50-81342). In these references, however, such problems arise that when the amount of the offset inhibitors added are small, sufficient effects cannot be achieved by the addition thereof, and that when it is large, the deterioration of the obtained developers is undesirably rapid.

On the other hand, as the copying machines are more generalized, they are highly likely to be used under severe environmental conditions, for instance, under high-temperature, high-humidity conditions or under low-temperature, low-humidity conditions. Therefore, formed images which are as clear as those obtained under normal conditions have to be obtained even under such severe environmental conditions. From this aspect, although the vinyl resins provide stable tribo electric charge without deteriorating formed images under the high-temperature, high-humidity conditions, their tribo electric charge undesirably increases under the low-temperature, low-humidity conditions, thereby undesirably decreasing the image concentration of the formed images.

In order to solve these problems, although various proposals have been so far made, the problems have not yet basically been solved.

As for the binding resins used for toners, polyesters which have a wide molecular weight distribution with particularly superior offset resistance and low-temperature fixing ability have been used. The polyesters are resins which are suitably used for providing low-molecular weight components effective for promoting the low-temperature fixing ability. Particularly, in a case where a toner comprises a polyester having an acid value of not less than 5 KOH mg/g, the toner has a good fixing ability at a low temperature and a satisfactorily good offset resistance, so that no deterioration of the developer obtained thereby takes place, even after copying several hundred thousands of sheets. As described above, when the polyester having a relatively high acid value is used for toner production, the resulting toner has an excellent fixing ability and the obtained developer has a long service life and a stable tribo electric charge under low-temperature, low-humidity conditions. However, in certain toner compositions, the tribo electric charge of the developer undesirably increases under high-temperature, high-humidity conditions, thereby showing a lack of environmental stability. On the other hand, in a case where a toner comprises a polyester having an acid value of not more than 5 KOH mg/g, the toner shows excellent properties in that the tribo electric charge thereof does not change even under severe environmental conditions, so that no deterioration takes place in the obtained developer. However, they are not satisfactorily good in the fixing ability.

In order to solve the above problems, the following methods for blending polyester resins having excellent fixing ability with styrene-acrylic resins having a small change in the tribo electric charge under the high-temperature, high-humidity conditions when compared with that under normal temperature, normal humidity conditions have been known. For instance, examples of such methods include:

(1) Methods for blending polyester resins with styrene-acrylic resins (see Japanese Patent Laid-Open Nos. 49-6931, 54-114245, 57-70523 and 2-161464);

(2) Methods for chemically binding polyester resins with styrene-acrylic resins (see Japanese Patent Laid-Open No. 56-116043);

(3) Methods for copolymerizing unsaturated polyesters with vinyl monomers (see Japanese Patent Laid-Open Nos. 57-60339, 63-279265, 1-156759 and 2-5073);

(4) Methods for copolymerizing polyester resins having an acryloyl group with vinyl monomers (see Japanese Patent Laid-Open No. 59-45453);

(5) Methods for copolymerizing reactive polyesters with vinyl monomers in the presence of polyester resins (see Japanese Patent Laid-Open No. 2-29664); and (6) Methods for forming a block copolymer by binding polyester resins and vinyl resins with an ester bond (see Japanese Patent Laid-Open No. 2-881).

However, since the polyester resins have inherently poor compatibility with the styrene-acrylic resins, mere mechanical blending of the components may result in poor dispersion of the resins and the internal additives such as carbon black at the time of production of the toner in certain blending ratios. This may lead to in turn cause a lack of uniformness in the chargeability of the toner, thereby causing such troubles as background in the formed images. Further, when the two types of resins have different molecular weights, the differences in their melt viscosities are likely to take place, thereby making it difficult to make the grain size of the resin for the dispersed domain fine. In such a case, when a toner is produced with such resins, the dispersion of the internal additives such as carbon black becomes extremely poor, so that such problem arises that the resulting toner gives greatly poor image quality. Moreover, in the case where the vinyl monomers are copolymerized with the reactive polyesters, it is applicable only in a restricted compositional range in order not to allow gelation to take place.

Further, toners as binder resins a resin composition having a matrix dispersed with domain particles to provide a microdomain structure have also been known (See Japanese Patent Laid-Open Nos. 4-366176 and 4-366854). However, since the matrices for these resins substantially comprises the styrene-acrylic resins, the problem of fixing failure inherent in the styrene-acrylic resins has not yet been solved.

Further, the present inventors have developed a technique in which the resins obtained by concurrently carrying out the addition polymerization and the condensation polymerization in the same reaction vessel are utilized for the binders for toner production (see Japanese Patent Laid-Open No. 4-142301). Although the binders for toner production disclosed herein have an islands-sea structure formed by dispersing a polyester resin in a styrene-acrylic resin, the diameter of the dispersed particles are larger than 2 $\mu$m. Therefore, in this reference, although the fixing temperature can be lowered, a further improvement in a life of the toner cannot be sufficiently obtained.

Accordingly, there is an increasing demand for a binder resin for electrophotography which is excellent in the low-temperature fixing ability and the offset resistance, has an environmental stability in tribo electric charge and image quality, which provides an excellent durability in the resulting toner.

SUMMARY OF THE INVENTION

An object of the present invention is to provide a stable toner capable of maintaining a suitable tribo electric charge, thereby providing a high image quality so that the formed images do not undergo deterioration even under severe environmental conditions.

As a result of intense research in view of the above problems, the present inventors have found that when a binder resin for electrophotography in which the addition polymerization-type resin having a diameter of not more than 2 $\mu$m is dispersed in a matrix of a condensation polymerization-type resin is used, a toner and thus a developer having good image quality so that the formed images do not undergo deterioration even under severe environmental conditions and having excellent low-temperature fixing ability and offset resistance can be obtained. The present invention is completed based upon this finding.

More particularly, the gist of the present invention is a toner for electrophotography comprising a binder resin, wherein said binder resin comprises a condensation polymerization-type resin for forming a matrix and an addition polymerization-type resin for forming a dispersed domain, the dispersed domain with a cross-sectional diameter of not more than 2 $\mu$m having an areal proportion of not less than 90%, based on the total cross-sectional area of the dispersed domain.

The toner of the present invention is stable, which is capable of maintaining a suitable tribo electric charge, thereby providing a high image quality in which the formed images do not undergo deterioration even under severe environmental conditions. Moreover, in a fixing method using a heat roller, fixing at a low temperature can be performed without using an offset inhibiting liquid.

DETAILED DESCRIPTION OF THE INVENTION

In the toner for electrophotography of the present invention, it is essential to form a matrix with the condensation polymerization-type resin, and to form a dispersed domain with the addition polymerization-type resin, the dispersed domain with a cross-sectional diameter of not more than 2 $\mu$m having an areal proportion of not less than 90%, based on the total cross-sectional area of the dispersed domain. Here, the cross-sectional diameter refers to the diameter of the dispersed domain as measured in a cross sectional area. When the dispersed domain with a cross-sectional diameter greater than 2 $\mu$m has an areal proportion exceeding 10%, a uniform binder resin cannot be obtained. Therefore, if such a binder resin is used for a toner, the charge stability becomes poor.

Here, the diameter and the areal proportion of the dispersed domain can be measured by the method comprising the steps of slicing the resin having a diameter of about 0.2 mm using a microtome to a thickness of 100 to 300 nm, observing the obtained thin slices using a transmission-type scanning electron microscope (for instance, "JEM-2000," manufactured by JEOL (Nihon Denshi Kabushiki Kaisha)), and then analyzing observed images by a known method.

The dispersion system described above can be produced by a method comprising the steps of blending a monomer mixture of two polymerization types, namely the condensation polymerization-type monomer and the addition polymerization-type monomer in advance, and then carrying out both of the polymerization reactions concurrently (Japanese Patent Laid-Open No. 4-142301). In particular, monomers capable of carrying out both the condensation polymerization and the addition polymerization can be preferably used. More specifically, the monomers having an unsaturated bond and a carboxyl group are allowed to react to produce the dispersion system.

In the present invention, preferred examples of the condensation polymerization-type resins include polyesters, polyester-polyamides, and polyamides. Among them, the polyesters can be obtained by the condensation polymerization of starting material monomers, namely the condensation polymerization between an alcohol and a carboxylic acid, a carboxylic acid anhydride or a carboxylic acid ester.

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A and other dihydric alcohol components.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol components.

Among these alcohol components, bisphenol A alkylene oxide adducts are preferably used. One or more alcohol components can be used.

In the present invention, these dihydric alcohol monomers and trihydric or higher polyhydric alcohol monomers may be used singly or in combination.

As for the acid components, examples of the dicarboxylic acid components include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, and acid anhydrides thereof, lower alkyl esters thereof and other dicarboxylic acid components.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, and acid anhydrides thereof, lower alkyl esters thereof and other tricarboxylic or higher polycarboxylic acid components.

In the present invention, among these carboxylic acid components, a preference is given to terephthalic acid, trimellitic acid, alkenyl succinic acid, fumaric acid and maleic acid. In particular, such monomers as fumaric acid and maleic acid are preferred because they are reactive for both the condensation polymerization and the addition polymerization. One or more acid components can be used.

These carboxylic acid components may be added in an amount of preferably 0.5 to 10% by weight, particularly 0.5 to 5% by weight, based on the condensation polymerization-type monomers used as a starting material.

Among the starting material monomers for forming the amide components in the polyester-polyamides or the polyamides which can be obtained by the condensation polymerization, examples of the starting material monomers include one or more polyamines such as ethylenediamine, pentamethylenediamine, hexamethylenediamine, diethylenetriamine, iminobispropylamine, phenylenediamine, xylylenediamine, and triethylenetetramine; amino carboxylic acids such as 6-aminocaproic acid; and amino alcohols such as propanolamine. Among these starting material for forming the amide components, a preference is given to hexamethylenediamine and ε-caprolactam.

Preferred examples of the addition polymerization-type resins are vinyl resins, and polymerization initiators such as peroxides and azo compounds may be preferably added at the time of polymerization.

Typical examples of the monomers used for forming the vinyl resins include styrene and styrene derivatives such as styrene, o-methylstyrene, m-methylstyrene, p-methylstyrene, a-methylstyrene, p-ethylstyrene, 2,4-dimethylstyrene, p-chlorostyrene, and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate, and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted monomers of ethylenic monocarboxylic acids such as acrylonitrile, methacrylonitrile and acrylamide; ethylenic dicarboxylic acids and substituted monomers thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone. In the present invention, a preference is given to styrene, acrylic acid, butyl acrylate, 2-ethylhexyl acrylate, methacrylic acid and butyl methacrylate.

Examples of the polymerization initiators which are used in the production of the vinyl resins include azo and diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

For the purposes of controlling the molecular weight or molecular weight distribution of the polymer or controlling the reaction time, two or more polymerization initiators may be used in combination.

The amount of the polymerization initiator used is 0.1 to 20 parts by weight, preferably 1 to 10 parts by weight, based on 100 parts by weight of the polymerizable monomers.

A crosslinking agent may be added, if necessary, to the monomer composition. In such a case, any known crosslinking agents may be appropriately used. Examples of crosslinking agents added include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl) propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate and diallyl phthalate. Among them, a preference is given to divinylbenzene and polyethylene glycol dimethacrylate. These crosslinking agents may be used alone or, if necessary, in combination of two or more.

The amount of these crosslinking agents used is preferably 0.001 to 15% by weight, more preferably 0.1 to 10% by weight, based on the polymerizable monomers. When the amount of these crosslinking agents used is more than 15% by weight, the resulting toner is unlikely to be melted with heat, thereby resulting in poor heat fixing ability and poor heat-and-pressure fixing ability. On the contrary, when the amount used is less than 0.001% by weight, in the heat-and-pressure fixing, a part of the toner cannot be completely fixed on a paper but rather adheres to the surface of a roller, which in turn is transferred to a subsequent paper, namely an offset phenomenon takes place.

In the present invention, the average-number molecular weight of the addition polymerization-type resins is 5,000 to 20,000, in which range the fixing ability of the resulting toner is remarkably good. When it is less than 5,000, the storage ability of the toner becomes poor, and when it exceeds 20,000, the fixing temperature becomes undesirably high. The average-number molecular weight of the addition polymerization-type resins can be easily controlled by adjusting the amounts of the polymerization initiators and the chain transfer agents or by adjusting the polymerization reaction temperature.

The polymerization reaction is carried out by the steps of adding a mixture comprising a starting material monomer for the vinyl resin dropwise to a mixture comprising starting material monomers for polyesters, polyester-polyamides or polyamides under temperature conditions appropriate for the addition polymerization reaction, the condensation polymerization being partly carried out concurrently with the addition polymerization reaction; keeping the temperature of the obtained mixture under said temperature conditions to complete only the addition polymerization reaction; and then raising the reaction temperature to increase degree of the condensation polymerization. Here, although the temperature conditions appropriate for the addition polymerization reaction may vary depending upon the types of the polymerization initiators, they are normally 50 to 180° C., and the optimum temperature for increasing degree of the condensation polymerization is normally 190 to 270° C. As mentioned above, by carrying out the two independent reactions concurrently, binder resins in which two kinds of resins are sufficiently blended and dispersed can be obtained.

The binder resin thus obtained preferably has a softening point of 95 to 170° C., more preferably 95 to 150° C., and a glass transition temperature of 50 to 80° C., more preferably 55 to 70° C. The softening point and the glass transition temperature may be easily controlled by adjusting the amounts of the polymerization initiators and the catalysts in the starting material monomer mixture, or by selecting suitable reaction conditions.

In the present invention, since the condensation polymerization-type resins form a matrix, the blending ratio (by weight) of the condensation polymerization-type resins to the addition polymerization-type resins or the blending ratio of the condensation polymerization-type resin monomers to the addition polymerization-type resin monomers is preferably in the range from 50/50 to 95/5, particularly from 70/30 to 90/10. When the proportion of the addition polymerization-type resins (or resin monomers) exceeds 50% by weight, the fixing ability of the resulting toner becomes poor, and when it is less than 5% by weight, the stability of the formed images under severe environmental conditions becomes undesirably poor.

The binder resin in the present invention preferably has an acid value of less than 20 KOH mg/g, in which range the obtained toner does not suffer from the decrease in the tribo electric charge even under high-temperature, high-humidity conditions. When the acid value of the binder resin is not less than 20 KOH mg/g, the obtained toner may undesirably suffer from decrease in the tribo electric charge depending upon its composition or the kinds of carriers used.

When the above binder resin is used in the production of toners, for example, it may be added together with a coloring agent, and if necessary, such additives as a charge control agent and a magnetic particulate.

Examples of the coloring agents used in the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, and Solvent Blue 35, and the mixtures thereof. The coloring agent is usually used in an amount of about 1 to 15 parts by weight based on 100 parts by weight of the binder resin.

In the present invention, if necessary, as the charge control agents either the positive charge control agents or the negative charge control agents may be used. The positive charge control agents are not particularly limitative, and examples thereof include nigrosine dyes such as "Nigrosine Base EX" (manufactured by Orient Chemical), "Oil Black BS" (manufactured by Orient Chemical), "Oil Black SO" (manufactured by Orient Chemical), "Bontron N-01" (manufactured by Orient Chemical), "Bontron N-07" (manufactured by Orient Chemical), and "Bontron N-11" (manufactured by Orient Chemical); triphenylmethane dyes containing tertiary amines as side chains; quaternary ammonium salt compounds such as "Bontron P-51" (manufactured by Orient Chemical), cetyltrimethylammonium bromide, and "Copy Charge PX VP435" (manufactured by Hoechst); polyamine resins such as "AFP-B" (manufactured by Orient Chemical); and imidazole derivatives such as "PLZ-2001" (manufactured by Shikoku Kasei K. K.) and "PLZ-8001" (manufactured by Shikoku Kasei K. K.), with a preference given to Bontron N-07.

Negative charge control agents to be added are not particularly limitative, and examples thereof include azo dyes containing metals such as "Varifast Black 3804" (manufactured by Orient Chemical), "Bontron S-31" (manufactured by Orient Chemical), "Bontron S-32" (manufactured by Orient Chemical), "Bontron S-34" (manufactured by Orient Chemical), "Bontron S-36" (manufactured by Orient Chemical), "T-77" (manufactured by Hodogaya Kagaku) and "Aizenspilon Black TRH" (manufactured by Hodogaya Kagaku); copper phthalocyanine dye; metal complexes of alkyl derivatives of salicylic acid such as "Bontron E-81" (manufactured by Orient Chemical), "Bontron E-82" (manufactured by Orient Chemical), "Bontron E-84" (manufactured by Orient Chemical), and "Bontron E-85" (manufactured by Orient Chemical); and quaternary ammonium salts such as "Copy Charge NX VP434" (manufactured by Hoechst); nitroimidazole derivatives, with a preference given to Bontron S-34.

The above charge control agents may be added to the binder resin in an amount of 0.1 to 8.0% by weight, preferably 0.2 to 5.0% by weight.

Also, preferred examples of the offset inhibitors include waxes such as polyolefins, which may be added in an amount of preferably 1 to 5 parts by weight, based on 100 parts by weight of the binder resin. Examples of the polyolefins include polyethylene and polypropylene, with a preference give to those having relatively low molecular weights, and particularly those having molecular weights of 3,000 to 15,000 as determined by the osmometric method are preferred. Also, the polyolefins have softening points of preferably 70 to 150° C., particularly 120 to 150° C. as determined by the ring and ball method.

In the conventional toners, blending of these waxes have been difficult due to their poor compatibility with the binder resin. By contrast, in the present invention, such waxes can be easily blended. By containing these waxes in the toner of the present invention, the low-temperature fixing ability of the toner becomes more excellent.

Further, in the production of the toners, there may be added property improvers, for instance, fluidity improvers such as hydrophobic silica. When the binder resin described above is used for the production of the toners in the present invention, these property improvers are not necessary. Even if they are used, they are contained in a small amount.

The toners having an average particle size of 5 to 15 μm can be obtained by the steps of uniformly dispersing the binder resin in the present invention, a coloring agent, and in certain cases, property improvers, melt-kneading the obtained mixture, cooling the kneaded mixture, pulverizing the cooled mixture, and then classifying the pulverized product, all of the steps being carried out by known methods. Also, the toners are blended with particulate magnetic materials such as iron oxide carriers, spherical iron oxide carrier or ferritic carriers, or the above carriers provided with a resin coating, to give a dry-type two-component developer.

A magnetic toner can be prepared by adding a particulate magnetic material to the starting material containing the above binder resin used in toner production. Examples of the particulate magnetic materials include ferromagnetic metals such as iron, i.e., ferrite or magnetite, cobalt, and nickel, alloys thereof, and compounds containing these elements; alloys not containing any ferromagnetic element which become ferromagnetic by suitable thermal treatment, for example, so-called "Heusler alloys" containing manganese and copper such as a manganese-copper-aluminum alloy, and a manganese-copper-tin alloy; and chromium dioxide, with a preference given to the compounds containing ferromagnetic materials, and a particular preference to magnetite. Such a magnetic material is uniformly dispersed in the starting material containing the above binder resin in the form of a fine powder having an average particle diameter of 0.1 to 1 μm. The content of these magnetic materials is 20 to 70 parts by weight, preferably 30 to 70 parts by weight, based on 100 parts by weight of the binder resin.

EXAMPLES

The present invention is hereinafter described in more detail by means of the following working examples, comparative examples and test example, but the present invention is not restricted to these examples.

In these examples, the acid value, the glass transition temperature and the molecular weight of each of the obtained binder resin are measured by the following methods.

Acid Value

The acid value is measured by the method according to JIS K0070.

Glass Transition Temperature (Tg)

The glass transition temperature (Tg) refers to the temperature of an intersection of the extension of the baseline of not more than the glass transition temperature and the tangential line showing the maximum inclination between the kickoff of the peak and the top thereof as determined with a sample using a differential scanning calorimeter ("DSC Model 200," manufactured by Seiko Instruments, Inc.), at a heating rate of 10° C./min. The sample is treated before measurement using the DSC by raising its temperature to 100° C., keeping at 100° C. for 3 minutes, and cooling the hot sample at a cooling rate of 10° C./min. to room temperature.

Molecular Weight Determination by Gel Permeation Chromatography (GPC)

The molecular weight of the obtained binder resin is measured by maintaining the temperature of a column in a thermostat set at 40° C. and injecting 100 μl of a chloroform solution of the sample, which is adjusted to have a sample concentration of 0.05 to 0.5% by weight, while flowing chloroform at a flow rate of 1 ml per minute as an eluent. The molecular weight of the sample is calculated by the molecular weight distribution determined from the retention time of the sample and a calibration curve prepared in advance. Here, the calibration curve is prepared from several kinds of monodisperse polystyrenes used as standard samples.

Column to be used: GMHLX+G3000HXL (manufactured by Tosoh Corporation)

Example 1

410 g of styrene and 90 g of 2-ethylhexyl acrylate as monomers for forming vinyl resins, and 20 g of azobisisobutyronitrile as a polymerization initiator are placed into a dropping funnel. 780 g of polyoxypropylene(2.2)-2,2-bis(4-hydroxyphenyl)propane, 24 g of fumaric acid, 76 g of isododecenyl succinic anhydride, 250 g of terephthalic acid and 2 g of dibutyltin oxide are placed in a five-liter four-neck glass flask equipped with a thermometer, a stainless steel stirring rod, a reflux condenser and a nitrogen inlet tube. To the mixture contained in the glass flask, the mixture comprising the monomers for forming the vinyl resins and the polymerization initiator is added dropwise from the above dropping funnel over a period of 1 hour while heating the contents at 135° C. in a mantle heater in a nitrogen gas atmosphere and stirring the contents. The reaction mixture is matured for 2 hours while keeping the temperature at 135° C., and then the temperature is elevated to 230° C. to react the components.

The degree of polymerization is monitored from a softening point measured by the method according to ASTM E 28–67, and the reaction is terminated when the softening point reaches 120° C.

The obtained resin has a glass transition temperature (Tg) with a single peak at 60° C. The average diameter of the dispersed domain of the vinyl resin is 0.5 μm, showing a good dispersion state. Also, the areal proportion of the dispersed domain having a cross-sectional diameter of not more than 2 μm is 97%. Here, the diameter of the dispersed domain can be measured by the method comprising the steps of slicing the resin having a diameter of 0.2 mm using a microtome to a thickness of 150 nm, and observing the obtained thin slices using a transmission scanning electron microscope ("JEM-2000," manufactured by JEOL (Nihon Denshi Kabushiki Kaisha)). The areal proportion of the dispersed domain is calculated by analyzing photographic images. The acid value is 8.0 KOH mg/g.

The polymerization reaction of the vinyl resin is completed before reaching the reaction temperature of 230° C. At completion, the vinyl resin has a number-average molecular weight of 10,000 as determined by gel permeation chromatography (GPC).

This obtained resin is referred to as "Binder Resin A."

Example 2

400 g of styrene and 77 g of 2-ethylhexyl acrylate as monomers for forming vinyl resins, 15 g of a-methylstyrene dimer as a chain transfer agent, and 25 g of dicumyl peroxide as a polymerization initiator are placed into a dropping funnel. 800 g of polyoxypropylene(2.2)-2,2-bis(4-hydroxyphenyl)propane, 15 g of fumaric acid, 60 g of 1,2,4-benzenetricarboxylic acid, 250 g of isophthalic acid and 2 g of dibutyltin oxide are placed in a five-liter four-neck glass flask equipped with a thermometer, a stainless steel stirring rod, a reflux condenser and a nitrogen inlet tube. The subsequent procedures are carried out under the same polymerization conditions as in Example 1.

The obtained resin is evaluated in the same manner as in Example 1. As a result, the resin has a glass transition temperature (Tg) with a single peak at 63° C., and the average diameter of the dispersed domain of the vinyl resin is 0.7 μm, showing a good dispersion state. Also, the areal proportion of the dispersed domain having a diameter of not more than 2 μm is 95%.

The acid value is 4.5 KOH mg/g. Also, the number-average molecular weight of the vinyl resin at completion of the addition polymerization reaction before raising the temperature to 230° C. is 5,000.

This obtained resin is referred to as "Binder Resin B."

Comparative Example 1

350 g of styrene and 150 g of n-butyl methacrylate as monomers for forming vinyl resins, and 25 g of dicumyl peroxide as a polymerization initiator are placed into a dropping funnel. 780 g of polyoxypropylene(2.2)-2,2-bis(4-hydroxyphenyl)propane, 240 g of isophthalic acid, 76 g of 1,2,4-benzenetricarboxylic acid, and 2 g of dibutyltin oxide are placed in a five-liter four-neck glass flask equipped with a thermometer, a stainless steel stirring rod, a reflux condenser and a nitrogen inlet tube. The subsequent procedures are carried out under the same polymerization conditions as in Example 1.

The obtained resin is evaluated in the same manner as in Example 1. As a result, the resin has a glass transition temperature (Tg) with a single peak at 62° C., and the average diameter of the dispersed domain of the vinyl resin is 5.0 μm, showing a poor dispersion state. Also, the areal proportion of the dispersed domain having a diameter of not more than 2 μm is 70%.

The acid value is 9.3 KOH mg/g. Also, the number-average molecular weight of the vinyl resin at completion of the addition polymerization reaction before raising the temperature to 230° C. is 17,000.

This obtained resin is referred to as "Binder Resin C."

Comparative Example 2

550 g of xylene is placed in a two-liter four-neck glass flask equipped with a thermometer, a stainless steel stirring rod, a reflux condenser and a nitrogen inlet tube. After replacing with a nitrogen gas, the temperature is elevated to 135° C.

700 g of styrene and 300 g of n-butyl methacrylate as monomers for forming vinyl resins and 50 g of dicumyl peroxide as a polymerization initiator are placed into a dropping funnel. To the contents of the glass flask, the above mixture is added dropwise from the above dropping funnel over a period of 1 hour while keeping the temperature at 135° C. The reaction mixture kept at 135° C. is matured for 2 hours, and then the temperature is elevated to 200° C. to complete the polymerization. Xylene is removed from the mixture under a reduced pressure, and the obtained product is taken out on a vat. After cooling the product, the cooled product is pulverized. The obtained resin has a softening point measured by the method according to ASTM E28–67 of 110° C. and a glass transition temperature of 66° C.

Also, the number-average molecular weight of the resin as determined by gel permeation chromatography (GPC) is 17,000.

This obtained resin is referred to as "Binder Resin D."

Next, 500 g of Binder Resin D obtained above, 800 g of polyoxypropylene(2.2)-2,2-bis(4-hydroxyphenyl)propane, 15 g of fumaric acid, 60 g of 1,2,4-benzenetricarboxylic acid, 250 g of isophthalic acid and 2 g of dibutyltin oxide are placed in a five-liter four-neck glass flask equipped with a thermometer, a stainless steel stirring rod, a reflux condenser and a nitrogen inlet tube. The contents are heated at 230° C. in a mantle heater in a nitrogen gas atmosphere to react the above components.

The degree of polymerization is monitored from a softening point measured by the method according to ASTM E 28–67, and the reaction is terminated when the softening point reaches 120° C.

The obtained resin is evaluated in the same manner as in Example 1. As a result, the resin has a glass transition temperature (Tg) with double peaks at 63° C. and 66° C. The average diameter of the dispersed domain of the vinyl resin is 10.0 μm, showing a large islands-sea structure (two-phase continuous phase). Also, the areal proportion of the dispersed domain having a diameter of not more than 2 μm is 10%. The acid value is 9.7 KOH mg/g.

This obtained resin is referred to as "Binder Resin E".

Comparative Example 3

780 g of polyoxypropylene(2.2)-2,2-bis(4-hydroxyphenyl)propane, 24 g of fumaric acid, 76 g of isododecenyl succinic anhydride, 250 g of terephthalic acid and 2 g of dibutyltin oxide, which are the same components used in Example 1, are allowed to react for homopolymerization.

The degree of polymerization is monitored from a softening point measured by the method according to ASTM E 28–67, and the reaction is terminated when the softening point reaches 110° C.

The obtained resin is evaluated in the same manner as in Example 1. As a result, the resin has a glass transition temperature of 63° C. Also, the acid value is 15.0 KOH mg/g.

780 g of the above resin is placed in a two-liter four-neck glass flask equipped with a thermometer, a stainless steel stirring rod, a reflux condenser and a nitrogen inlet tube as in Example 1. The obtained resin is dissolved by adding 250 g of xylene, and then the temperature is elevated to 135° C.

Next, 410 g of styrene and 90 g of 2-ethylhexyl acrylate as monomers for forming vinyl resins, and 20 g of azobisisobutyronitrile as a polymerization initiator, which are the same components used in Example 1, are placed into a dropping funnel. To the contents of the above glass flask, the above mixture is added dropwise from the above dropping funnel over a period of 1 hour while keeping the temperature at 135° C. The reaction mixture kept at 135° C. is matured for 2 hours, and then the temperature is elevated to 200° C. to react the components. Xylene is removed from the mixture under a reduced pressure, and when the softening point reaches 120° C., the obtained product is taken out on a vat. After cooling the product, the cooled product is pulverized.

The obtained resin is evaluated in the same manner as in Example 1. As a result, the resin has a glass transition temperature with double peaks at 63° C. and 65° C. The average diameter of the dispersed domain of the vinyl resin is 7.0 μm, showing a large islands-sea structure. Also, the areal proportion of the dispersed domain having a diameter of not more than 2 μm is 25%. Also, the acid value is 9.0 KOH mg/g.

This obtained resin is referred to as "Binder Resin F."

Comparative Example 4

780 g of polyoxypropylene(2.2)-2,2-bis(4-hydroxyphenyl)propane, 240 g of isophthalic acid, 76 g of 1,2,4-benzenetricarboxylic acid, and 2 g of dibutyltin oxide, which are the same components used in Comparative Example 1, are placed in a five-liter four-neck glass flask equipped with a thermometer, a stainless steel stirring rod, a reflux condenser and a nitrogen inlet tube, and the obtained mixture is allowed to react for homopolymerization.

The obtained resin is evaluated in the same manner as in Example 1. As a result, the resin has a softening point of 130° C. and a glass transition temperature of 60.3° C. Also, the acid value is 15.0 KOH mg/g.

This obtained resin is referred to as "Binder Resin G."

Comparative Example 5

820 g of styrene and 180 g of 2-ethylhexyl acrylate as monomers for forming vinyl resins, and 40 g of azobisisobutyronitrile as a polymerization initiator are placed into a dropping funnel. 390 g of polyoxyethylene(2.2)-2,2-bis(4-hydroxyphenyl)propane, 12 g of fumaric acid, 55 g of isododecenyl succinic anhydride, 110 g of terephthalic acid and 1 g of dibutyltin oxide are placed in a five-liter four-neck glass flask equipped with a thermometer, a stainless steel stirring rod, a reflux condenser and a nitrogen inlet tube. The subsequent procedures are carried out under the same polymerization conditions as in Example 1.

The obtained resin is evaluated in the same manner as in Example 1. As a result, the resin has a glass transition temperature as determined by a differential scanning calorimeter (DSC) with a single peak at 60° C. The average diameter of the polyester resin is 8.0 μm, showing a large islands-sea structure. Also, the areal proportion of the dispersed domain having a diameter of not more than 2 μm is 20%. The acid value is 8.0 KOH mg/g.

This obtained resin is referred to as "Binder Resin H."

Example 3

410 g of styrene and 90 g of 2-ethylhexyl acrylate as monomers for forming vinyl resins, and 20 g of dicumyl peroxide as a polymerization initiator are placed into a dropping funnel. 800 g of polyoxypropylene(2.2)-2,2-bis(4-hydroxyphenyl)propane, 10 g of fumaric acid, 255 g of terephthalic acid, 60 g of 1,2,4-benzenetricarboxylic acid, and 2 g of dibutyltin oxide are placed in a five-liter four-neck glass flask equipped with a thermometer, a stainless steel stirring rod, a reflux condenser and a nitrogen inlet tube. To the mixture contained in the glass flask, the mixture comprising the monomers for forming the vinyl resins and the polymerization initiator is added dropwise from the above dropping funnel over a period of 1 hour while heating the contents at 160° C. in a mantle heater in a nitrogen gas atmosphere and stirring the contents. The reaction mixture is matured for 2 hours while keeping the temperature at 160° C., and then the temperature is elevated to 230° C. to react the components. The subsequent procedures are carried out under the same polymerization conditions as in Example 1.

The obtained resin is evaluated in the same manner as in Example 1. As a result, the resin has a glass transition temperature (Tg) with a single peak at 61° C., and the average diameter of the dispersed domain of the vinyl resin is 1.5 μm, showing a good dispersion state. Also, the areal proportion of the dispersed domain having a diameter of not more than 2 μm is 92%.

The acid value is 8.7 KOH mg/g. Also, the number-average molecular weight of the vinyl resin at completion of the addition polymerization reaction before raising the temperature to 230° C. is 7,500.

This obtained resin is referred to as "Binder Resin I."

Comparative Example 6

410 g of styrene and 90 g of 2-ethylhexyl acrylate as monomers for forming vinyl resins, and 20 g of dicumyl peroxide as a polymerization initiator are placed into a dropping funnel. 800 g of polyoxypropylene(2.2)-2,2-bis(4-hydroxyphenyl)propane, 4 g of fumaric acid, 260 g of terephthalic acid, 60 g of 1,2,4-benzenetricarboxylic acid, and 2 g of dibutyltin oxide are placed in a five-liter four-neck glass flask equipped with a thermometer, a stainless steel stirring rod, a reflux condenser and a nitrogen inlet tube. To the mixture contained in the glass flask, the mixture comprising the monomers for forming the vinyl resins and the polymerization initiator is added dropwise from the above dropping funnel over a period of 1 hour while heating the contents at 160° C. in a mantle heater in a nitrogen gas atmosphere and stirring the contents. The reaction mixture is matured for 2 hours while keeping the temperature at 160° C., and then the temperature is elevated to 230° C. to react the components. The subsequent procedures are carried out under the same polymerization conditions as in Example 1.

The obtained resin is evaluated in the same manner as in Example 1. As a result, the resin has a glass transition temperature (Tg) with a single peak at 62° C., and the average diameter of the dispersed domain of the vinyl resin is 3.0 μm. Also, the areal proportion of the dispersed domain having a diameter of not more than 2 μm is 80%.

The acid value is 9.2 KOH mg/g. Also, the number-average molecular weight of the vinyl resin at completion of the addition polymerization reaction before raising the temperature to 230° C. is 8,000.

This obtained resin is referred to as "Binder Resin J."

Test Example

Each of the materials having the composition shown in Table 1 is blended with a Henschel mixer in advance, and the obtained mixture is melt-blended using a double-screw extruder. After cooling the extruded product, the cooled product is pulverized and classified to give an untreated toner having an average particle diameter of 11 μm.

TABLE 1

| Components | | Untreated Toner (parts by weight) 1 | 2 | 3 | 4 | 5 | 6 | 7 | 8 | 9 | 10 | 11 |
|---|---|---|---|---|---|---|---|---|---|---|---|---|
| Binder Resin | A | 90 | | 90 | 90 | | | | | | | |
| | B | | 90 | | | | | | | | | |
| | C | | | | | 90 | | | | | | |
| | D | | | | | | | | 35 | | | |
| | E | | | | | | 90 | | | | | |
| | F | | | | | | | 90 | | | | |
| | G | | | | | | | | 65 | | | |
| | H | | | | | | | | | 90 | | |
| | I | | | | | | | | | | 90 | |
| | J | | | | | | | | | | | 90 |
| Carbon Black #44[1] | | 7 | 7 | 7 | 7 | 7 | 7 | 7 | 7 | 7 | 7 | 7 |
| BONTRON S-34 ™ [2] | | 2 | 2 | | 2 | 2 | 2 | 2 | 2 | 2 | 2 | 2 |
| BONTRON N-07 ™ [3] | | | | 2 | | | | | | | | |
| Low-Molecular Weight Polypropylene [4] | | | | | 3 | | | | | | | |

Notes:
[1] Manufactured by Mitsubishi Kasei Corporation.
[2] Negative charge control agent (manufactured by Orient Chemical)
[3] Positive charge control agent (manufactured by Orient Chemical)
[4] VISCOL 66OP ™ (manufactured by Sanyo Chemical Industries, Ltd.)

0.1 parts by weight of hydrophobic silica "H-2000" (manufactured by Wacker Chemical Co.) is blended with 100 parts by weight of each of the obtained untreated toners 1 to 4 and 10 using a Henschel mixer to give Toners 1 to 5. Similarly, each of the untreated toners 5 to 9 and 11 are surface-treated to give Comparative Toners 1 to 6.

The tests for the tribo electric charge and the fixing ability are evaluated using a developer prepared by blending 39 parts by weight of each of the toners with 1261 parts by weight of spherical ferrite powder coated with styrene-methyl methacrylate resin having an average particle diameter of 100 $\mu$m. Specifically, each of the developers prepared as described above is loaded on a commercially available electrophotographic copying machine to develop images. The copying machine is equipped with an amorphous selene photoconductor for Toners 1, 2, 4, 5, Comparative Toners 1, 2, 3, 4, 5, and 6, or an organic photoconductor for Toner 3; a fixing roller having a rotational speed of 255 mm/sec; a fixing device with variable heat roller temperature; and an oil applying device being removed from the copying machine. The tribo electric charge, the fixing ability and the offset resistance of the formed images are evaluated by the following methods.

(1) Tribo electric charge

The tribo electric charge is measured by a blow-off type electric charge measuring device equipped with a Faraday cage, a capacitor and an electrometer as described below. First, W (g) (about 0.15 to 0.20 g) of the developer prepared above is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, thereby selectively removing only the toner from the cell.

In this case, the voltage of the electrometer after 2 seconds from the start of blowing is defined as V (volt). Here, when the electric capacitance of the capacitor is defined as C ($\mu$F), the tribo electric charge Q/m of this toner can be calculated by the following equation:

$$Q/m(\mu C/g)=C\times V/m$$

Here, m is the weight of the toner contained in W (g) of the developer. When the weight of the toner in the developer is defined as T (g) and the weight of the developer as D (g), the toner concentration in a given sample can be expressed as T/D×100(%), and m can be calculated as shown in the following equation:

$$m(g)=W\times(T/D)$$

Each of the above developer is loaded on the above copying machine to conduct continuous copying test for 100,000 sheets under normal conditions of 23° C. and 50%RH or under high-temperature, high-humidity conditions of 35° C. and 85%RH. The changes in the tribo electric charge and the occurrence of background obtained during copying are evaluated. The results are shown in Table 2.

TABLE 2

| | Particle Diameter of Vinyl Resin Dispersed in Binder Resin ($\mu$m) | Tribo Electric Charge at Start ($\mu$c/g) | Changes in Tribo Electric Charge (after copying 100,000 Sheets): Copying under Normal Conditions of 23° C., 50% RH | Copying under High-Temp., High-Humidity Conditions of 35° C., 85% RH | Image Quality: Copying under Normal Conditions of 23° C., 50% RH | Copying under High-Temp., High-Humidity Conditions of 35° C., 85% RH |
|---|---|---|---|---|---|---|
| Toner 1 | 0.5 | −18.5 | −1 | −2 | Excellent after Copying 100,000 Sheets | Excellent after Copying 100,000 Sheets |
| Toner 2 | 0.7 | −20.0 | −1 | −3 | Excellent after Copying 100,000 Sheets | Excellent after Copying 100,000 Sheets |
| Toner 3 | 0.5 | +19.5 | +1 | −1 | Excellent after Copying 100,000 Sheets | Excellent after Copying 100,000 Sheets |
| Toner 4 | 0.5 | −18.6 | −1 | −2 | Excellent after Copying 100,000 Sheets | Excellent after Copying 100,000 Sheets |
| Toner 5 | 1.5 | −19.0 | −1 | −2 | Excellent after Copying 100,000 Sheets | Excellent after Copying 100,000 Sheets |

TABLE 2-continued

| | Particle Diameter of Vinyl | | Changes in Tribo Electric Charge (after copying 100,000 Sheets) | | Image Quality | |
|---|---|---|---|---|---|---|
| | Resin Dispersed in Binder Resin (μm) | Tribo Electric Charge at Start (μc/g) | Copying under Normal Conditions of 23° C., 50% RH | Copying under High-Temp., High-Humidity Conditions of 35° C., 85% RH | Copying under Normal Conditions of 23° C., 50% RH | Copying under High-Temp., High-Humidity Conditions of 35° C., 85% RH |
| Comparative Toner 1 | 5.0 | −19.1 | +3 | +7 | Background Caused at 70,000 Sheets | Background Caused at 50,000 Sheets |
| Comparative Toner 2 | 10.0 | −18.5 | +12 | +15 | Intense Background Caused at 5,000 Sheets | Intense Background Caused at 2,000 Sheets |
| Comparative Toner 3 | 7.0 | −19.3 | +8 | +10 | Intense Background Caused at 3,000 Sheets | Intense Background Caused at 500 Sheets |
| Comparative Toner 4 | — | −20.2 | +10 | +11 | Intense Background Caused at 4,000 Sheets | Intense Background Caused at 2,000 Sheets |
| Comparative Toner 5 | 8.0* | −19.1 | +3 | −6 | Background Caused at 70,000 Sheets | Background Caused at 60,000 Sheets |
| Comparative Toner 6 | 3.0 | −18.7 | +2 | +5 | Background Caused at 80,000 Sheets | Background Caused at 70,000 Sheets |

Note *: Dispersed resin is a polyester resin.

(2) Fixing ability

The fixing ability is evaluated by determining the lowest fixing temperature.

The lowest fixing temperature used herein is the temperature of the fixing roller at which the fixing ratio of the toner exceeds 70%. This fixing ratio of the toner is determined by placing a load of 500 g on a sand-rubber eraser (LION No. 502) having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Co., and then calculating the fixing ratio from this density value and a density value before the eraser treatment using the following equation.

$$\text{Fixing ratio (\%)} = \frac{\text{Image density after eraser treatment}}{\text{Image density before eraser treatment}} \times 100$$

By controlling the fixing temperature from 100° C. to 240° C., the fixing ability of the formed images are evaluated. The results are shown in Table 3.

(3) Offset resistance

The offset resistance is evaluated by measuring the temperature of the low-temperature offset disappearance and the temperature of the high-temperature offset initiation. Specifically, copying tests are carried out by raising the temperature of the heat roller surface at an increment of 5° C. in the range from 70° C. to 240° C., and at each temperature, the adhesion of the toner onto the heat roller surface is evaluated with the naked eye.

TABLE 3

| | Image Density | Lowest Fixing Temp. (° C.) | Low-Temp. Offset Disappearing Temp. (° C.) | High-Temp. Offset Initiating Temp. (° C.) |
|---|---|---|---|---|
| Toner 1 | 1.40 | 127 | 122 | 240< |
| Toner 2 | 1.41 | 125 | 120 | 240< |
| Toner 3 | 1.42 | 127 | 121 | 240< |
| Toner 4 | 1.40 | 127 | 115 | 241< |
| Toner 5 | 1.40 | 126 | 120 | 240< |
| Comparative Toner 1 | 1.40 | 130 | 122 | 240< |
| Comparative Toner 2 | 1.30 | 145 | 135 | 210 |
| Comparative Toner 3 | 1.35 | 140 | 130 | 200 |
| Comparative Toner 4 | 1.32 | 139 | 135 | 205 |
| Comparative Toner 5 | 1.39 | 131 | 125 | 240< |
| Comparative Toner 6 | 1.40 | 128 | 121 | 240< |

As is clear from Table 2, with respect to Toners 1 to 5 according to the present invention, the changes in the tribo electric charges are small and excellent image quality is maintained, when compared with Comparative Toners 1 to 6 under the normal conditions of 23° C. and 50%RH as well as under the high-temperature, high-humidity conditions of 35° C. and 80%RH. Therefore, Toners 1 to 5 according to the present invention is highly applicable for copying even under severe environmental conditions.

Further, as is clear from Table 3, Toners 1 to 5 according to the present invention have remarkably low lowest fixing temperatures and low low-temperature offset disappearing temperatures when compared with Comparative Toners 2 to 4. Therefore, Toners 1 to 5 according to the present invention has excellent stability in the resulting formed images and thus show excellent heat efficiency.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for making a toner for electrophotography which comprises mixing a starting material monomer or mixture of monomers for vinyl resin dispersed domain particles, and starting material monomers for a polyester resin matrix, wherein the weight ratio of monomers for said polyester resin matrix to monomer or mixture of monomers for said vinyl resin dispersed domain particles is 50/50 to 95/5, wherein an acid component of the starting material monomer for the polyester resin matrix comprises one or more monomers, which are reactive for both the condensation polymerization and the addition polymerization, selected from the group consisting of fumaric acid, maleic acid, and anhydrides thereof and lower alkyl esters thereof, and wherein said one or more monomers, which are reactive for both the condensation polymerization and the addition polymerization, are used in an amount of 0.5 to 10% by weight based on the starting material monomers for said polyester resin matrix, concurrently carrying out addition polymerization and condensation polymerization to produce a binder resin, wherein the areal proportion of said vinyl resin dispersed domain particles having a cross-sectional diameter of not more than 2 $\mu$m is not less than 90%, said areal proportion of not less than 90% being calculated based on the total cross-sectional diameter of all of the dispersed domain particles, said binder resin having a Tg of 50° to 80° C.;

uniformly dispersing said binder resin and a coloring agent;

melt-kneading the obtained mixture;

cooling the kneaded mixture;

pulverizing the cooled mixture; and classifying the pulverized product to produce said toner.

2. The process according to claim 1, wherein the starting material monomer for the vinyl resin dispersed domain particles is selected from the group consisting of styrene, acrylic acid, n-butyl acrylate, t-butyl acrylate, 2-ethylhexyl acrylate, methacrylic acid, n-butyl methacrylate and t-butyl methacrylate.

3. The process according to claim 1, wherein the acid component of the starting material monomer for the polyester resin matrix further comprises one or more monomers selected from the group consisting of terephthalic acid, trimellitic acid and alkenyl succinic acid.

4. The process according to claim 1, wherein an alcohol component of the starting material monomer for the polyester resin matrix comprises bisphenol A alkylene oxide adducts.

* * * * *